US009919885B2

(12) United States Patent
Lochbichler et al.

(10) Patent No.: US 9,919,885 B2
(45) Date of Patent: Mar. 20, 2018

(54) APPARATUS FOR SEPARATING SHEET MATERIAL

(71) Applicant: WINCOR NIXDORF INTERNATIONAL GMBH, Paderborn (DE)

(72) Inventors: Matthias Lochbichler, Paderborn (DE); Christopher Lankeit, Paderborn (DE); Martin Landwehr, Paderborn (DE); Ludger Hoischen, Borchen (DE)

(73) Assignee: Diebold Nixdorf, Incorporated, North Canton, OH (US)

( * ) Notice: Subject to any disclaimer, the term of this patent is extended or adjusted under 35 U.S.C. 154(b) by 0 days.

(21) Appl. No.: 15/361,408

(22) Filed: Nov. 26, 2016

(65) Prior Publication Data

US 2017/0073178 A1 Mar. 16, 2017

Related U.S. Application Data

(62) Division of application No. 14/788,494, filed on Jun. 30, 2015, now Pat. No. 9,688,501.

(30) Foreign Application Priority Data

Jul. 1, 2014 (EP) ..... 14175256

(51) Int. Cl.
*B65H 3/40* (2006.01)
*B65H 3/20* (2006.01)
(Continued)

(52) U.S. Cl.
CPC ..... *B65H 3/40* (2013.01); *B65H 3/0816* (2013.01); *B65H 3/20* (2013.01); *B65H 7/14* (2013.01);
(Continued)

(58) Field of Classification Search
CPC ..... B65H 3/40; B65H 3/20; B65H 3/0816; B65H 7/14
See application file for complete search history.

(56) References Cited

U.S. PATENT DOCUMENTS 2,566,175 A * 8/1951 Ferdinand ..... B65H 3/0825 271/91
3,934,693 A 1/1976 Ooyama et al.
(Continued)

FOREIGN PATENT DOCUMENTS

CN 201449625 U 5/2010
DE 1917795 A1 11/1969
(Continued)

OTHER PUBLICATIONS

Groot et al., "Evidence for an elastic projection mechanism in the chameleon tongue", Proceedings of the Royal Society of London B, vol. 271, Issue 1540, Apr. 7, 2004, pp. 761-770.
(Continued)

*Primary Examiner* — Patrick Cicchino
(74) *Attorney, Agent, or Firm* — Black, McCuskey Souers & Arbaugh, LPA

(57) ABSTRACT

A device and a method for separating sheet material is provided. The separation of sheet material is not effected statically, but a suitable pick-up position and/or a suitable pick-up mechanism is selected for each sheet material piece, for example in dependence on the quality of a surface of the sheet material piece to be picked up, in order to pick up the sheet material piece from the sheet material stack and remove it from the same.

14 Claims, 3 Drawing Sheets

(51) Int. Cl.

| | |
|---|---|
| ***B65H 3/08*** | (2006.01) |
| ***B65H 7/14*** | (2006.01) |
| ***G07D 11/00*** | (2006.01) |
| ***B65H 43/08*** | (2006.01) |
| *B65H 29/24* | (2006.01) |
| *B65H 39/10* | (2006.01) |

(52) U.S. Cl.

CPC ..... *B65H 43/08* (2013.01); *G07D 11/0024* (2013.01); *B65H 29/241* (2013.01); *B65H 39/10* (2013.01); *B65H 2404/5391* (2013.01); *B65H 2406/34* (2013.01); *B65H 2511/232* (2013.01); *B65H 2511/413* (2013.01); *B65H 2511/414* (2013.01); *B65H 2511/416* (2013.01); *B65H 2553/42* (2013.01); *B65H 2701/1912* (2013.01)

(56) References Cited

U.S. PATENT DOCUMENTS

| | | | | |
|---|---|---|---|---|
| 6,684,787 | B1 | 2/2004 | Sauer | |
| 7,604,231 | B2 * | 10/2009 | Yuen | B65H 3/40 270/58.33 |
| 7,614,619 | B2 * | 11/2009 | Yuen | B65H 3/06 271/11 |
| 8,467,597 | B2 | 6/2013 | Monti et al. | |
| 9,126,771 | B2 * | 9/2015 | Saison | B65H 3/0816 |
| 9,272,859 | B2 * | 3/2016 | Sato | B65H 3/0669 |
| 2008/0122166 | A1 | 5/2008 | Fukube | |
| 2008/0179002 | A1 * | 7/2008 | Gromadzki | B65H 3/02 156/701 |
| 2008/0265500 | A1 * | 10/2008 | Katsuyama | B21D 43/20 271/264 |
| 2008/0310863 | A1 | 12/2008 | Honguh | |
| 2009/0057980 | A1 * | 3/2009 | Gibson | B65G 59/04 271/3.09 |
| 2009/0116728 | A1 | 5/2009 | Agrawal | |
| 2012/0027483 | A1 | 2/2012 | Hayashihara | |
| 2013/0108408 | A1 | 5/2013 | Saison et al. | |
| 2013/0334770 | A1 | 12/2013 | Fehrenbach et al. | |
| 2015/0170349 | A1 | 6/2015 | Mochizuki | |

FOREIGN PATENT DOCUMENTS

| | | | | |
|---|---|---|---|---|
| DE | 2437994 | C3 | 11/1978 | |
| DE | 68903694 | T2 | 4/1993 | |
| DE | 19939164 | B4 | 2/2005 | |
| DE | 102009010426 | A1 | 9/2010 | |
| DE | 102011000783 | A1 | 8/2012 | |
| WO | 2006/108409 | A1 | 10/2006 | |
| WO | 2011/071794 | A1 | 6/2011 | |
| WO | 2013/034117 | A1 | 3/2013 | |
| WO | 2014/005715 | A1 | 1/2014 | |
| WO | WO 2017021103 | A1 * | 2/2017 | B65H 3/0816 |

OTHER PUBLICATIONS

Herrel et al., "The Mechanics of Prey Prehension in Chameleons", The Journal of Experimental Biology, vol. 203, Nov. 1, 2000, pp. 3255-3263.

* cited by examiner

APPARATUS FOR SEPARATING SHEET MATERIAL

CROSS-REFERENCE TO RELATED APPLICATION

This application is a divisional of U.S. patent application Ser. No. 14/788,494, filed Jun. 30, 2015, which claims priority to European Patent Application No. 14175256.8, filed on Jul. 1, 2014. The foregoing applications are incorporated herein by reference.

BACKGROUND

The present invention relates to apparatus for separating sheet material as well as methods for separating sheet material.

Generic devices for separating sheet material on the one hand include a sheet material pick-up which is configured to pick up a single sheet material piece from a sheet material stack which comprises several sheet material pieces, and on the other hand an actuator which is configured to shift the sheet material pick-up. The actuator for example puts the sheet material pick-up into a particular movement, so that the sheet material pick-up for example can withdraw the uppermost sheet material piece or the bottommost sheet material piece of a sheet material stack from the sheet material stack.

Such device for separating sheet material is described for example in WO 2014/005715 A1. The sheet material pick-up is configured there in the manner of an oscillating conveyor belt with which single sheet material pieces can be removed from a sheet material stack.

The sheet material for example can be paper sheets, cardboard sheets, coupons, for example banknotes, bills, checks or the like.

In systems which process such sheet material, for example coupons, use occasionally is made of an image acquisition unit which captures an image of a surface of a sheet material piece and provides corresponding image data. An evaluation unit downstream of the image acquisition unit provides an evaluation result in dependence on the evaluation of the image data, wherein the system continues to process the processing of the sheet material pieces in dependence on this evaluation result. Such approach for example is known from DE 10 2011 000 783 A1. By means of the image acquisition unit and the evaluation unit an authenticity check of the coupon is made.

SUMMARY

In the known devices for separating sheet material it can be problematic that occasionally it is not possible to pick up single sheet material pieces and/or that during removal from the sheet material stack they lose their adhesion to the sheet material pick-up and in so far have a certain unreliability.

It may be desirable to provide means which allow a more reliable separation of sheet material.

In accordance with a first aspect, a device is presented. The device is configured to determine a pick-up position in dependence on the evaluation result and position the sheet material pick-up at the pick-up position, in order to pick up the sheet material piece at the pick-up position and remove it from the sheet material stack. The pick-up position for example designates a particular point of the surface of the single sheet material piece, at which the sheet material pick-up is to be positioned, in order to pick up the single sheet material piece from the sheet material stack.

In accordance with a second aspect, a further device is presented. The further device is configured to pick up the single sheet material piece selectively by means of a first pick-up mechanism of the sheet material pick-up and/or by means of a second pick-up mechanism of the sheet material pick-up, in order to remove the sheet material piece from the sheet material stack.

The following explanations refer both to the device of the first aspect and to the device of the second aspect.

The present invention includes the finding that the surfaces of the sheet material pieces to be separated of the sheet material stack, in particular the respective adhesion properties of the sheet material pieces, can vary from each other. The variance of the surface quality of the single sheet material pieces can result from a variety of reasons: For example, the sheet material stack is a stack of unsorted sheet material pieces, for example an accumulation of different types of sheet material pieces. For example, the sheet material stack comprises coupons of different denomination. Coupons of different denominations have different surface qualities, wherein these differences for example can result from the different security features of these coupons. In addition, the sheet material pieces can distinctly differ from each other with regard to their age and their condition, which likewise can have an influence on the respective surface quality. Some sheet material pieces for example have holes and/or tears, which influences the adhesion properties at the respective points of the surface of the sheet material pieces.

It is an idea that the separation of sheet material is not effected statically and independent of the sheet material to be separated, but that in dependence on the quality of the sheet material pieces to be separated of the sheet material stack an adaption of the separation process is made.

According to an embodiment, this adaptation for example is expressed in that for each sheet material piece of the sheet material stack a suitable pick-up position is determined, at which the respective single sheet material piece is picked up and removed from the sheet material stack.

According to a further embodiment, this adaptation for example is expressed in that for each sheet material piece of the sheet material stack a suitable pick-up mechanism is selected, in order to pick up the respective single sheet material piece and remove it from the sheet material stack. The sheet material pick-up of the device of the second aspect of the present invention accordingly is configured to implement at least two (or several) pick-up mechanisms different from each other and the device selects one or more selection mechanisms for the respective separation process, in order to carry out the separation.

The features of the device of the first aspect advantageously can be combined with the features of the second aspect. The device of the first aspect for example is configured to pick up the sheet material piece selectively by means of the first pick-up mechanism of the sheet material pick-up and/or by means of the second pick-up mechanism of the sheet material pick-up, in order to remove the sheet material piece from the sheet material stack. In an exemplary embodiment of the device of the second aspect it is provided that the device includes an image acquisition unit which is configured to capture an image of a surface of the single sheet material piece and to provide image data, and an evaluation unit downstream of the image acquisition unit, which is configured to receive the image data and to provide an evaluation result in dependence on an evaluation of image data, wherein the device is configured to select the first and/or the second pick-up mechanism in dependence on the evaluation result.

In one embodiment, the evaluation unit is configured to determine the type of the sheet material piece to be picked up, for example the denomination of a coupon, with reference to the image data and to determine the adhesion properties in dependence on the determined type of sheet material piece. In connection with the evaluation, the evaluation unit for example determines that the sheet material piece to be picked up is a 5-Euro note. For example, the evaluation unit is configured to access a memory in which various standard adhesion properties are stored for various types of sheet material pieces. For example, in dependence on the particular type of sheet material piece the evaluation unit determines the standard adhesion properties associated to the particular type of sheet material piece and provides the evaluation result in dependence on the determined standard adhesion properties. For coupons of different denomination, the standard adhesion properties for example can determine at which points the respective coupons have suitable adhesion properties.

In the following, further embodiments of the device of the first aspect and of the device of the second aspect will be described. The features of these further embodiments can be combined both with each other and with the optional features already described above to form further exemplary embodiments, unless they expressly have been described as alternative to each other.

In one embodiment, the evaluation unit is configured to determine adhesion properties of a surface of the sheet material piece with reference to the image data and provide the evaluation result in dependence on the adhesion properties. Depending on the adhesion properties of the surface of the sheet material piece, either a suitable pick-up position is determined for picking up the sheet material piece and/or the first or second pick-up mechanism is selected for example in dependence on the evaluation result. In other words, it is preferred that the evaluation result is indicative for the pick-up position and/or for the pick-up mechanism to be used. For example, the evaluation result indicates that at a particular pick-up position of the single sheet material piece to be picked up the first pick-up mechanism is to be used, in order to successfully pick up the sheet material piece from the sheet material stack and remove it from the same.

In a further embodiment, the sheet material pick-up includes first means for executing the first pick-up mechanism, wherein the first means are configured to pick up the sheet material piece by generating a first force of attraction, for example a suction force. The sheet material pick-up for example comprises a suction cup, in order to suck up the single sheet material piece and in this way pick it up from the sheet material stack. In an exemplary embodiment, the device is configured to determine a suitable pick-up position in dependence on the evaluation result, to position the sheet material pick-up at this pick-up position by means of the actuator, and to then pick up the sheet material piece from the sheet material stack with the first means and subsequently shift the sheet material pick-up with the sheet material piece picked up by means of the actuator, in order to move the sheet material piece picked up away from the sheet material stack towards another position.

For example, the first means includes a suction sleeve and a suction piston movably arranged in the suction sleeve, wherein the suction piston is configured to generate a negative pressure by its movement in an empty space of the suction sleeve defined by the suction sleeve, the suction piston and the surface of the single sheet material piece. The suction sleeve for example is coupled to a guide element of the actuator via a coupling piece.

In a further embodiment, the sheet material pick-up includes second means for executing the second pick-up mechanism, wherein the second means are configured to pick up the sheet material piece by generating a second force of attraction, for example a van der Waals force. For example, the second means comprises an adhesive film which is designed to form a van der Waals force upon contact with the surface of the single sheet material piece. The adhesive film for example is a so-called Gecko adhesive film, for example a film of the type Gecko® Nanoplast® of the enterprise Gottlieb Binder.

For example, on a surface which faces the sheet material stack the adhesive film comprises a plurality of microscopic elements, such as for example small hairs arranged vertically to the film, for example in a density of about some thousand pieces per $cm^2$, for example 25,000 pieces per $cm^2$. The adhesive film preferably has a thickness of less than one millimeter, for example 0.3 mm. For example, the adhesive film has a surface area of a few square centimeters.

In a further embodiment, the sheet material pick-up of the device is configured to pick up the sheet material piece selectively by operating the first means and/or the second means.

The selection of the first means and/or the second means for picking up the single sheet material piece selectively can be effected in dependence on an evaluation logic which is implemented for example in said evaluation unit, i.e. is based on an evaluation of the image data, and/or inherently by the sheet material pick-up itself, e.g., without any logic (without software-based evaluation).

In one embodiment, the sheet material pick-up hence includes a mechanical selection means which is configured to select the pick-up mechanism in dependence on the quality of the surface of the single sheet material piece. In other words, the sheet material pick-up preferably is designed such that it automatically chooses the pick-up mechanism suitable for the quality of the surface of the single sheet material piece based on its mechanical construction. This will be explained in more detail below:

On the one hand, it is possible that the device includes said image acquisition unit and said evaluation unit. In this case, the evaluation unit for example is equipped such that the evaluation result provided by the same is indicative for the pick-up mechanism to be selected, i.e. indicative for the first and/or second means of the sheet material pick-up to be selected. The evaluation result for example indicates that the sheet material piece is to be picked up by exerting a suction force and/or by exerting a van der Waals force. The determination of the pick-up mechanism to be selected, however, also can be based on another evaluation logic and on an evaluation of image data.

On the other hand, the selection of the first means and/or of the second means also can be effected without any logic, which will be explained with reference to a further embodiment: When the first means includes said suction sleeve and suction piston, the adhesive film for example is arranged on an end face of the suction piston and/or on an end face of the suction sleeve, wherein the end face of the suction piston and the end face of the suction sleeve each point towards the surface of the single sheet material piece to be picked up. When the device positions the sheet material pick-up on the surface of the sheet material piece, for example at the determined pick-up position, the surface of the single sheet material piece first contacts the adhesive film which is arranged on the end face of the suction sleeve and/or on the end face of the suction piston, so that the van der Waals force is formed. When the actuator then shifts the sheet material pick-up, in order to pick up the sheet material piece from the sheet material stack and remove it from the same, the sheet material piece picked up adheres to the sheet material pick-up, in case the amount of the van der Waals force formed is sufficient to provide this adhesion. When this is not the case, i.e. the van der Waals force formed is not sufficient to pick up the single sheet material piece from the sheet material stack, the suction piston movably arranged in the suction sleeve is axially shifted within the suction sleeve due to the movement of the sheet material pick-up and thereby generates a negative pressure in the empty space created by shifting the suction piston, which space is defined by the surface of the single sheet material piece, an inner wall of the suction sleeve and by the end face of the suction piston, and as a result generates a suction force which in any case is sufficient to ensure that the single sheet material piece picked up remains stuck to the sheet material pick-up.

Due to this mechanism, possible weaknesses of the first means and possible weaknesses of the second means are compensated. For example, at the point engaged by the sheet material pick-up the sheet material piece to be picked up has a comparatively rough surface, so that the van der Waals forces can be formed only insufficiently, but due to the suction force produced, then the sheet material piece to be picked up nevertheless can be picked up by the sheet material pick-up and can be removed from the sheet material stack. When the sheet material piece to be picked up for example has one or more small holes at the point which is engaged by the sheet material pick-up, it is not unlikely that the sheet material piece to be picked up cannot successfully be picked up by means of suction force, because the hole or the holes eliminate the delimitation of the empty space and in so far it might not be possible to form the negative pressure and hence the suction force. In this case, the single sheet material piece nevertheless can be picked up, because the hole or the holes do not necessarily prevent the formation of the van der Waals force.

As has already been explained above at some points, the actuator for example is configured to shift the sheet material pick-up. The actuator for example is configured to put the sheet material pick-up into a translational movement along a first direction substantially vertical to a perpendicular direction, in order to position the sheet material pick-up at the sheet material stack, for example at the determined pick-up position, and/or in order to remove the single sheet material piece picked up from the sheet material stack, wherein the first direction for example is substantially vertical to a long side of the single sheet material piece.

In another embodiment, the actuator alternatively or in addition is configured to put the sheet material pick-up into a translational movement along a second direction substantially vertical to the perpendicular direction, in order to position the sheet material pick-up at the sheet material stack, for example at the determined pick-up position, and/or in order to remove the single sheet material piece picked up from the sheet material stack, wherein the second direction for example is substantially parallel to a long side of the single sheet material piece.

In other words, it is preferred that the actuator is configured to shift the sheet material pick-up along one or more directions, which is/are substantially parallel to the surface of the sheet material piece picked up. In another embodiment, the actuator furthermore is configured to put the sheet material pick-up into a translational movement along the perpendicular direction and attach it there to the surface of the single sheet material piece, in order to pick up the single sheet material piece, and/or in order to remove the single sheet material piece picked up from the sheet material stack.

It hence is preferred that the sheet material pick-up is movably mounted in several axes within the device, in order to be positioned at the sheet material stack for picking up the single sheet material piece and be removed from the sheet material stack, in order to deposit the single sheet material piece picked up at some other point or hand it over to another processing component.

A third aspect is formed by a method characterized by determining a pick-up position in dependence on the evaluation result and positioning the sheet material pick-up at the pick-up position, in order to pick up the single sheet material piece at the pick-up position and remove it from the sheet material stack. A fourth aspect is formed by a method characterized by selecting a first pick-up mechanism of the sheet material pick-up and/or a second pick-up mechanism of the sheet material pick-up, in order to pick up the single sheet material piece by means of the selected pick-up mechanism and remove it from the sheet material stack. The methods of these further aspects share the advantages of the devices of the first two aspects and include preferred embodiments which correspond to the above-described preferred embodiments of the devices. In so far, reference is made to the above explanations.

The presented aspects are suitable for separating any type of sheet material and for example can be used in a sheet material processing system. For example, the aspects can be used for separating coupons, such as bills or banknotes. The aspects advantageously can be used for example in a self-service terminal, for example a cash dispenser.

In the above explanation of the aspects, reference always has been made to a sheet material stack. For example, the sheet material stack is a stack of banknotes, in which the banknotes are layered one above the other in perpendicular direction. For example, the sheet material stack is a coupon stack which is arranged in a coupon cassette. On the other hand, the sheet material stack can however also be an unordered accumulation of all kinds of sheet material pieces. The sheet material pieces need not necessarily be substantially parallel and layered one above the other, but the aspects, e.g., also allow a separation of sheet material pieces which are present substantially unordered and unsorted.

Furthermore, in the above explanation of the aspects reference always has been made to a first pick-up mechanism and a second pick-up mechanism. However, the present invention is not limited to only two different pick-up mechanisms. Rather, further pick-up mechanisms also can be implemented in the sheet material pick-up. Beside exerting a suction force and/or exerting a van der Waals force, it is possible for example to effect an adhesion of the single sheet material piece to the sheet material pick-up by generating electrostatic forces.

BRIEF DESCRIPTION OF THE DRAWINGS

The idea underlying the invention will be explained in detail below with reference to the exemplary embodiments illustrated in the Figures.

DETAILED DESCRIPTION

Figure 1:
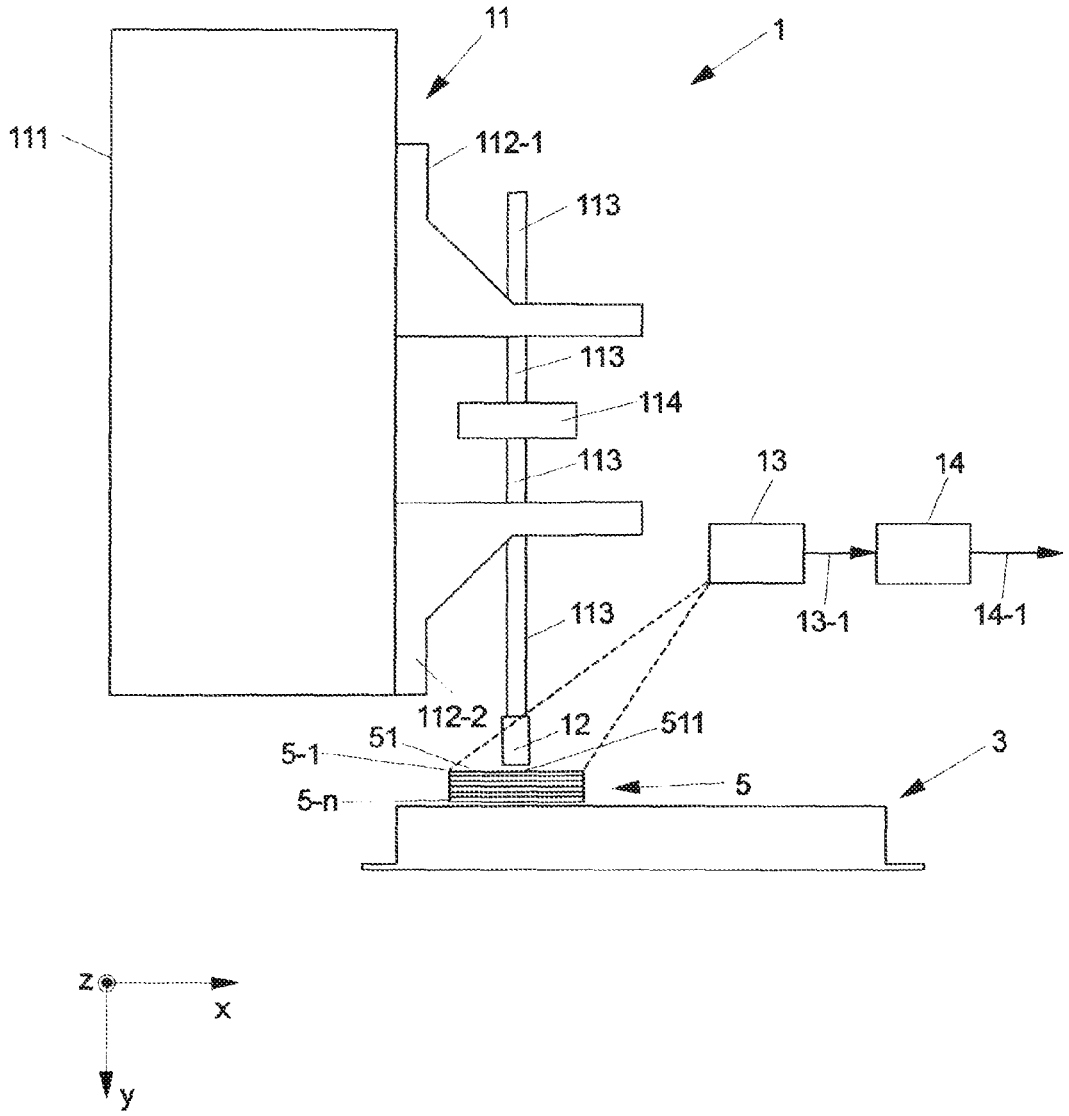
FIG. 1 shows a schematic cross-sectional view of an exemplary embodiment of a device for separating sheet material.

FIG. 1 shows a schematic cross-sectional view of an exemplary embodiment of a device 1 for separating sheet material. FIG. 1 shows the device 1 merely schematically, in order to explain the function of the device 1. The arrangement of the individual components of the device 1, as they are shown in FIG. 1, hence not necessarily is to be understood as specification for a practical implementation.

The device 1 for separating sheet material includes a sheet material pick-up 12 which is configured to pick up a single sheet material piece 5-1 from a sheet material stack 5. The sheet material stack 5 comprises several sheet material pieces 5-1 to 5-n. In the illustrated exemplary embodiment, the single sheet material pieces 5-1 to 5-n are layered one above the other along a perpendicular direction y. The single sheet material pieces 5-1 to 5-n can, however, also be present in the form of a substantially unordered accumulation. The sheet material stack 5 is located on a sheet material support 3.

For shifting the sheet material pick-up 12 an actuator 11 is provided, which on a base 111 is coupled via a first coupling element 112-1 and a second coupling element 112-2. The actuator 11 in addition includes a guide element 113 which is connected with the sheet material pick-up 12. Via the guide element 113, the sheet material pick-up 12 is shifted along the perpendicular direction y. For example, the actuator 11 places the sheet material pick-up 12 on a surface 51 of the uppermost sheet material piece 5-1 without exerting a pressing force, in order to pick up the uppermost sheet material piece 5-1 from the sheet material stack 5. Furthermore, the actuator 11 can put the sheet material pick-up 12 into a translational movement along a first direction x substantially vertical to the perpendicular direction y, in order to position the sheet material pick-up 12 at the sheet material stack 5 and/or in order to remove a single sheet material piece picked up from the sheet material stack 5. In the illustrated example, the first direction x is substantially vertical to a long side L (cf. FIG. 2) of the single sheet material piece 5-1. In addition, the actuator 11 can put the sheet material pick-up 12 into a translational movement along a second direction z substantially vertical to the perpendicular direction y, again in order to position the sheet material pick-up 12 at the sheet material stack 5 and/or in order to remove a single sheet material piece picked up from the sheet material stack 5, wherein the second direction is substantially parallel to the long side L of the single sheet material piece 5-1.

As a result, the sheet material pick-up 12 of the device 1 is movably mounted along the three directions x, y and z, in order to on the one hand be positioned at the sheet material stack 5 and on the other hand remove a sheet material piece picked up from the sheet material stack 5. For shifting the sheet material pick-up 12, the device 1 can comprise corresponding linear motors (not shown in FIG. 1). Alternatively and/or in addition, the sheet material pick-up 12 can movably be mounted also in directions other than the directions x, y and z. For example, the sheet material pick-up 12 also is movably mounted along one or more directions of rotation, in order to be positioned at the sheet material stack 5 and/or to be shifted, in order to remove a sheet material piece picked up from the sheet material stack 5.

To support shifting and/or positioning of the sheet material pick-up 12 by means of the actuator 11, the device 1 can be equipped with a sensor device 114 which determines the values of one or more measurement quantities, in order to control the process of sheet material separation. In FIG. 1, this sensor device 114 is shown merely schematically.

Figure 4:
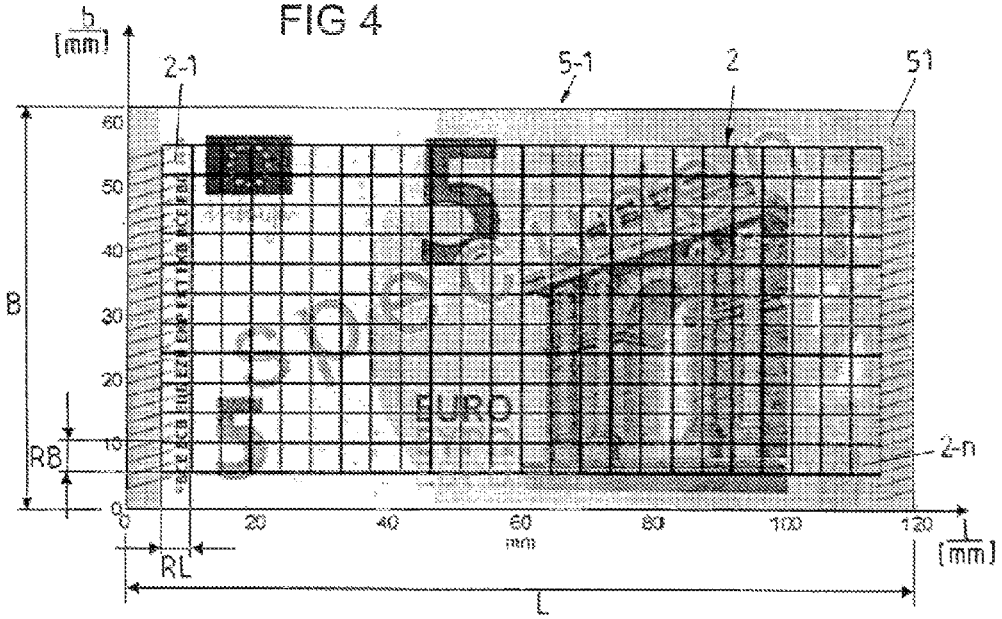
FIG. 4 shows a schematic view of an exemplary sheet material piece.

The device 1 furthermore comprises an image acquisition unit 13 which is configured to capture an image of the surface 51 of the single sheet material piece 5-1 and to provide corresponding image data 13-1. An evaluation unit 14 of the device 1 downstream of the image acquisition unit 13 receives the image data 13-1 and in dependence on an evaluation of the image data 13-1 provides an evaluation result 14-1. An exemplary function of the image acquisition unit 13 and the evaluation unit 14 will be explained with reference to FIG. 4 and FIG. 5:

FIG. 4 shows a schematic view of an exemplary sheet material piece, and for the following example it should be assumed that the sheet material piece of FIG. 4 is the uppermost sheet material piece 5-1. In the illustrated example, the sheet material piece 5-1 is a 5-Euro note. The sheet material piece 5-1 has a length L and a width B. On the abscissa axis the length I is indicated in millimeters and on the ordinate axis the width b, likewise in millimeters. For the optical analysis of the surface 51 of the sheet material piece 5-1 a grid 2 is used, which includes a plurality of identical grid elements 5-1 to 5-n. The grid elements 2-1 to 2-n each have the same grid element width RB and the same grid element length RL. In the illustrated example, the grid element width RB is 5 mm and the grid element length RL likewise is 5 mm.

Figure 5:
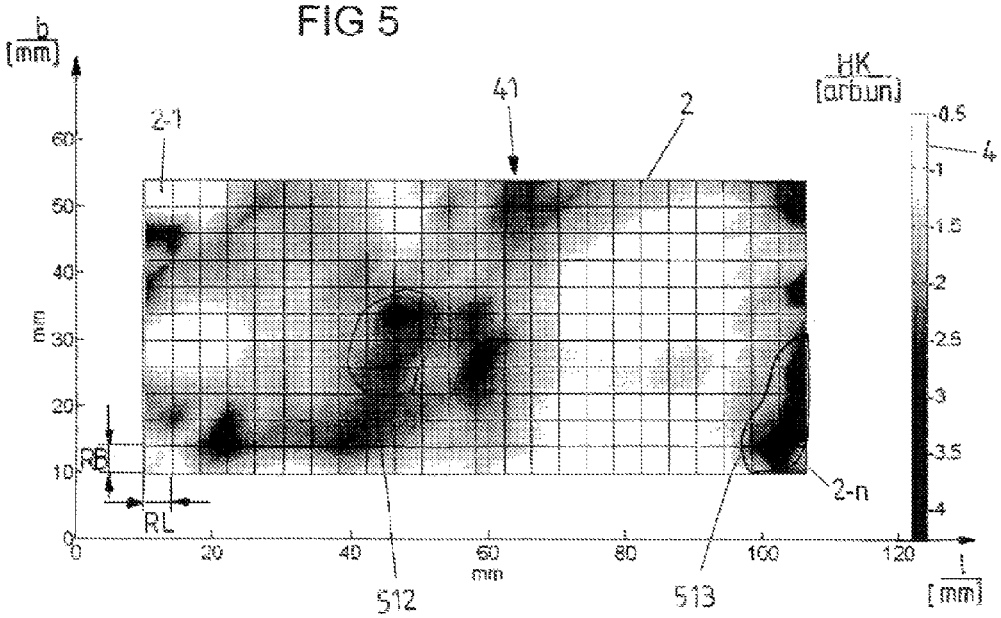
FIG. 5 shows a schematic representation of adhesion properties of the sheet material piece shown in FIG. 4.

For example, the evaluation unit 14 is configured to determine the adhesion properties of the surface 51 of the sheet material piece 5-1 with reference to the image data 13-1. FIG. 5 shows a schematic representation of adhesion properties of the sheet material piece 5-1 shown in FIG. 4. On the left ordinate axis, the width b in turn is plotted in millimeters, and on the abscissa axis the length I, likewise in millimeters. The right ordinate axis indicates an adhesive force HK in an arbitrary unit, wherein dark shading represents a strong adhesive force and light shading represents a low adhesive force. FIG. 5 thus shows an adhesive force distribution 41 which finally represents at which points the surface 51 of the sheet material piece 5-1 has advantageous adhesion properties. Corresponding to the adhesive force distribution 41, advantageous points for example are located in a first region 512 or in a second region 513.

The determination of the adhesion properties by the evaluation unit 14 can be effected in various ways. For example, one variant provides that the evaluation unit 14 independently determines the adhesion properties based on an evaluation algorithm with reference to the image data 13-1. Another variant provides that the evaluation unit 14 determines a type of the sheet material piece 5-1 with reference to the image data 13-1 and then accesses a memory (not shown in the Figures) in which predetermined standard adhesion properties each are stored for a number of types of sheet material. Based on the example concretely shown in the Figures, the evaluation unit 14 thus determines with reference to the image data 13-1 that the sheet material piece 5-1 is a 5-Euro note, and by using the memory thereupon detects that the 5-Euro note for example has the adhesion properties schematically shown in FIG. 5.

In one variant, the device 1 is configured to determine a pick-up position 511 with reference to the evaluation result 14-1 and to position the sheet material pick-up 12 by means of the actuator 11 at the determined pick-up position 511 at the sheet material piece 5-1, in order to pick up the sheet material piece 5-1 at the pick-up position 511 by means of the sheet material pick-up 12 and then remove it from the sheet material stack 5. With reference to the optical evaluation of the sheet material stack 5 by means of the image acquisition unit 13 and the evaluation unit 14 a determination of a suitable pick-up position 511 is effected, at which the sheet material piece 5-1 advantageously can be picked up by means of the sheet material pick-up 12. For example, the pick-up position 511 is located in said first region 512 or in the second region 513. Thus, it is possible to pick up the respective sheet material piece to be picked up of the sheet material stack 5 at a corresponding suitable pick-up position in dependence on the quality of the sheet material piece to be picked up and in this way increase the reliability of the device 1 for separating sheet material.

In another variant, which does not necessarily require the presence of the image acquisition unit 13 and the evaluation unit 14, the device 1 is configured to selectively pick up the sheet material piece 5-1 by means of a first pick-up mechanism of the sheet material pick-up 12 and/or by means of a second pick-up mechanism of the sheet material pick-up 12, in order to remove the sheet material piece 5-1 from the sheet material stack 5. In this variant, the sheet material pick-up 12 is designed to selectively actuate a first pick-up mechanism and/or a second pick-up mechanism, in order to pick up the sheet material piece 5-1. For this purpose, the sheet material pick-up includes a first means which is configured to execute the first pick-up mechanism and a second means which is configured to execute the second pick-up mechanism.

The selection of the pick-up mechanism, i.e. the selection of the first means or the second means of the sheet material pick-up 12, for example likewise is effected in dependence on the quality of the sheet material piece 5-1 to be picked up. The selection on the one hand can be effected without any logic (without a software-based evaluation), in that the sheet material pick-up 12 is constructed such that the selection is effected automatically, which will be explained in detail later on with respect to FIG. 2, and/or the selection of the pick-up mechanism is effected based on a software-controlled evaluation of the quality of the surface 51 of the sheet material piece 5-1 to be picked up, for example by means of said image acquisition unit 13 and said evaluation unit 14. For example, the evaluation unit 14 determines a type of the sheet material piece 5-1 to be picked up with reference to the image data 13-1 and in dependence on the particular type of the sheet material piece 5-1 selects the first and/or the second pick-up mechanism, in order to pick up the sheet material piece 5-1 from the sheet material stack 5 with the selected pick-up mechanism or with the two pick-up mechanisms, and to remove it from said stack.

Figure 2:
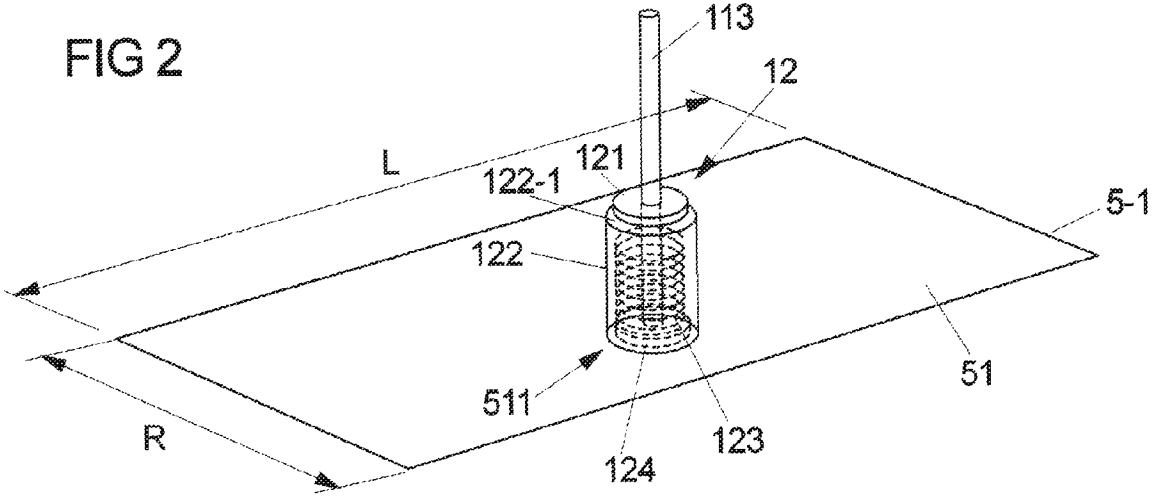
FIG. 2 shows a perspective and schematic view of an exemplary sheet material pick-up.
Figure 3:
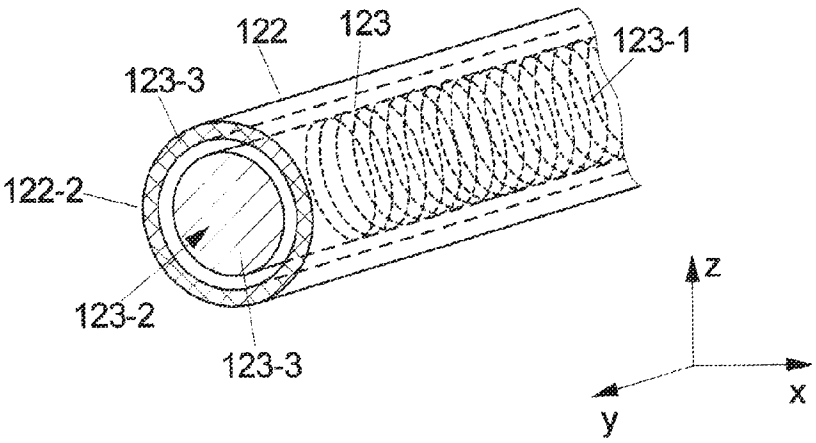
FIG. 3 shows a schematic cross-sectional view of the sheet material pick-up shown in FIG. 2.

With respect to FIG. 2 and FIG. 3 that variant will now be explained, in which the selection of the pick-up mechanism is effected without any logic and solely based on the mechanical construction of the sheet material pick-up 12. For illustration purposes, FIG. 2 merely shows the single sheet material piece 5-1. This sheet material piece is picked up by the sheet material pick-up 12, which for these purposes has been positioned at the sheet material stack 5 by the actuator 11 and has been attached to the surface 51 of the sheet material piece 5-1. In the illustrated example, the sheet material pick-up 12 is configured to selectively execute the first pick-up mechanism or the second pick-up mechanism.

The sheet material pick-up 12 is configured to selectively pick up the sheet material piece 5-1 by generating a suction force (first pick-up mechanism) or by generating a van der Waals force (second pick-up mechanism). For these purposes, the sheet material pick-up 12 includes a suction sleeve 122 which at a coupling cap 122-1 is coupled to the guide element 113 of the actuator via a coupling piece 121. In the suction sleeve 122 a suction piston 123 is movably arranged along the perpendicular direction y, for example via a spring element 123-1. The suction piston is configured to generate a negative pressure by its movement against the perpendicular direction y in an empty space 124 defined by the suction sleeve 122, the surface 51 of the single sheet material piece 5-1 and an end face 123-2 of the suction piston 123.

On the other hand, an adhesive film 123-3 is applied onto an end face of the suction sleeve 122-2 and onto the end face of the suction piston 123-2, which film is configured to generate a van der Waals force upon contact with the surface 51 of the sheet material piece 5-1. The adhesive film 123-3 for example is a so-called Gecko film, for example a Gecko® Nanoplast® film of the enterprise Gottlieb Binder.

When the sheet material pick-up 12 now is positioned at the sheet material stack 5 by the actuator 11 and is attached to the surface 51 of the sheet material piece 5-1, said van der Waals forces therefore are generated due to the adhesive film 123-3 between the surface 51 and the end faces 122-2 and 123-2. When the actuator 11 now puts the sheet material pick-up 12 into a translational movement against the perpendicular direction y, the sheet material piece 5-1 remains stuck to the sheet material pick-up 12, in case the van der Waals force generated is large enough. If this is not the case, the suction piston 123 is shifted against the perpendicular direction y within the suction sleeve 122 due to the pulling force of the guide element 113, whereby a negative pressure and hence a suction force is obtained in said empty space 124.

The selection of a suitable pick-up mechanism is expedient, because the surface 51 of the sheet material piece 5-1 to be picked up can be different at the pick-up position 511; for example, the surface 51 has a number of holes at the pick-up position 511, so that the sheet material pick-up 12 cannot pick up the sheet material piece 5-1 by forming a suction force, because the suction force does not take effect due to the holes. In this case, however, picking up the sheet material piece 5-1 succeeds by means of the adhesive film 123-3. When the surface 51 of the sheet material piece 5-1 however has a comparatively rough surface at the pick-up position 511, the van der Waals force generated might not be sufficient, which however does not preclude the separation, as the sheet material pick-up 12 in this case nevertheless can pick up the sheet material piece 5-1 from the sheet material stack 5 by generating the suction force.

With reference to the above explanation of concrete exemplary embodiments, an idea should be expressed, namely that the separation of sheet material is not effected statically, but that for each sheet material piece 5-1 to 5-n a suitable pick-up position 511 and/or a suitable pick-up mechanism is selected, for example in dependence on the quality of the sheet material piece 5-1 to be picked up, in order to pick up the sheet material piece from the sheet material stack and remove it from the same. Both possibilities can be combined with each other. Hence, it is possible to determine the suitable pick-up position 511, to position the sheet material pick-up 12 at the determined pick-up position, and then to select the suitable pick-up mechanism or the means provided therefore, in order to pick up the sheet material piece 5-1 from the sheet material stack 5 and remove it from the same.

With respect to the above Figures not only the exemplary device 1 for separating sheet material has been explained, but also a method for separating sheet material, e.g., a method for separating sheet material by means of the device 1 explained above.

LIST OF REFERENCE NUMERALS/USED ABBREVIATIONS

1 device for separating sheet material
11 actuator
111 base
112-1 first coupling element
112-2 second coupling element
113 guide element
114 sensor device
12 sheet material pick-up
121 coupling piece
122 suction sleeve
122-1 coupling cap
122-2 end face of the suction sleeve
123 suction piston
123-1 spring element
123-2 end face of the suction piston
123-3 adhesive film
124 empty space
13 image acquisition unit
13-1 image data
14 evaluation unit
14-1 evaluation result
2 grid
2-1, . . . , 2-n grid elements
3 sheet material support
4 scale
41 adhesive force distribution
5 sheet material stack
5-1, . . . , 5-n sheet material pieces
51 surface of the uppermost sheet material piece 5-1
511 pick-up position
512 first region
513 second region
B width of a single sheet material piece
L length of a single sheet material piece
RB grid element width
RL grid element length
x x-axis/first direction
y y-axis/perpendicular direction
z z-axis/second direction

The invention claimed is:

1. A device for separating sheet material, comprising:

a sheet material pick-up which is configured to pick up a single sheet material piece from a sheet material stack, which includes several sheet material pieces; and an actuator which is configured to shift the sheet material pick-up, wherein, the device is configured to selectively pick up the single sheet material piece by a first pick-up mechanism of the sheet material pick-up and/or by a second pick-up mechanism of the sheet material pick-up, in order to remove the single sheet material piece from the sheet material stack, and, wherein, the first pick-up mechanism of the sheet material pick-up and the second pick-up mechanism of the sheet material pick-up are of different type mechanisms.

2. The device according to claim 1, further comprising:

an image acquisition unit which is configured to capture an image of a surface of the single sheet material piece and to provide image data; and an evaluation unit downstream of the image acquisition unit, which is configured to receive the image data and to provide an evaluation result in dependence on an evaluation of the image data; wherein, the device is configured to select the first and/or the second pick-up mechanism in dependence on the evaluation result.

3. The device according to claim 1, wherein the sheet material pick-up comprises the first pick-up mechanism, which is configured to pick up the sheet material piece by generating a first force of attraction that is a suction force.

4. The device according to claim 3, wherein the sheet material pick-up comprises the second pick-up mechanism, which is configured to pick up the sheet material piece by generating a second force of attraction that is a van der Waals force.

5. The device according to claim 3, wherein the first pick-up mechanism comprises a suction sleeve and a suction piston movably arranged in the suction sleeve, wherein the suction piston is configured to generate a negative pressure by its movement in an empty space of the suction sleeve defined by the suction sleeve and the surface of the single sheet material piece.

6. The device according to claim 5, wherein the suction sleeve is coupled to a guide element of the actuator via a coupling piece.

7. The device according to claim 5, wherein the second pick-up mechanism comprises an adhesive film which is designed to form a van der Waals force upon contact with the surface of the single sheet material piece and wherein the adhesive film is arranged on at least one of an end face of the suction piston and an end face of the suction sleeve.

8. The device according to claim 1, wherein the second pick-up mechanism is configured to pick up the sheet material piece by generating a second force of attraction that is a van der Waals force.

9. The device according to claim 8, wherein the second pick-up mechanism comprises an adhesive film which is designed to form a van der Waals force upon contact with the surface of the single sheet material piece.

10. The device according to claim 1, wherein the actuator is configured to put the sheet material pick-up into a translational movement along a first direction substantially vertical to a perpendicular direction, in order to position the sheet material pick-up at the single sheet material piece and/or in order to remove the single sheet material piece picked up from the sheet material stack, wherein the first direction is substantially vertical to a long side of the single sheet material piece.

11. The device according to claim 10, wherein the actuator is configured to put the sheet material pick-up into a translational movement along a second direction substantially vertical to the perpendicular direction, in order to position the sheet material pick-up at the single sheet material piece and/or in order to remove the single sheet material piece picked up from the sheet material stack, wherein the second direction is substantially parallel to a long side of the single sheet material piece.

12. The device according to claim 1, wherein the actuator is configured to put the sheet material pick-up into a translational movement along a perpendicular direction, in order to perform at least one of positioning the sheet material pick-up at the single sheet material piece and removing the single sheet material piece picked up from the sheet material stack.

13. A method for separating sheet material by a sheet material pick-up which is configured to pick up a single sheet material piece from a sheet material stack, which includes several sheet material pieces, and an actuator which is configured to shift the sheet material pick-up, the method comprising:

selectively picking up the single sheet material piece by a first pick-up mechanism of the sheet material pick-up and/or by a second pick-up mechanism of the sheet material pick-up, in order to remove the single sheet material piece from the sheet material stack, wherein, the first pick-up mechanism of the sheet material pick-up and the second pick-up mechanism of the sheet material pick-up are of different type mechanisms.

14. The method according to claim 13, further comprising:

shifting the sheet material pick-up using the actuator.

* * * * *